US005401022A

United States Patent [19]

McCready

[11] Patent Number: 5,401,022

[45] Date of Patent: Mar. 28, 1995

[54] TEE PUTTER

[76] Inventor: Stephen McCready, 4901 Sunny Pl., Met Airie, La. 70006

[21] Appl. No.: 225,790

[22] Filed: Apr. 11, 1994

[51] Int. Cl.[6] ..... A63B 53/14

[52] U.S. Cl. ..... 273/81.2; 273/81.3

[58] Field of Search ..... 273/81.3, 81.2, 81 R, 273/81 C, 81 D, 77 R, 165

[56] References Cited

U.S. PATENT DOCUMENTS

| | | | |
|---|---|---|---|
| 1,616,377 | 2/1927 | Knight | 273/81.3 |
| 3,663,019 | 5/1972 | Palotsee | 273/81.2 |
| 4,819,944 | 4/1989 | Doane | 273/81.3 X |
| 5,088,738 | 2/1992 | Mundt et al. | 273/81.3 X |
| 5,106,095 | 4/1992 | Pitkethly | 273/77 R X |

*Primary Examiner*—George J. Marlo
*Attorney, Agent, or Firm*—Michael J. Colitz, Jr.

[57] ABSTRACT

A new and improved tee putter comprising a rectangular putting head with a striking surface that is generally flat. The rectangular putting head functions to contact a golf ball. A metal shaft has a lower end and an upper end and an intermediate extent. The lower end being is secured to the rectangular putting head. A cross bar is perpendicularly integral to the upper end of the metal shaft with an externally threaded right end and an externally threaded left end. The apparatus has a right locking sleeve and a left locking sleeve. The right locking sleeve has a first end and a second end. The first end of the right locking sleeve is internally threaded. The left locking sleeve has a first end and a second end. The first end of the left locking sleeve is internally threaded. The internal thread of the right locking sleeve is engaged with the external thread of the right end of the cross bar. The internal thread of the left locking sleeve is engaged with the external thread of the left end of the cross bar. The apparatus has a right handle and a left handle. The right handle and left handle have a small end and a large end. The small end of the right handle is secured to the second end of the right locking sleeve. The small end of the left handle is secured to the second end of the left locking sleeve.

3 Claims, 3 Drawing Sheets

TEE PUTTER

BACKGROUND OF THE INVENTION

1. Field of the Invention

The present invention relates to a tee putter and more particularly pertains to a putter which increases putting accuracy by allowing the user to putt with his arms in a parallel relationship.

2. Description of the Prior Art

The use of golf putters is known in the prior art. More specifically, golf putters heretofore devised and utilized for the purpose of putting golf balls are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,125,657 to Beil a putter with pendulum action. The putter employs the principle of the pendulum as its primary operating concept.

U.S. Pat. No. 3,874,668 to Flege discloses a pendulum golf putter. A golf putter adapted for pendulum type swinging movement by use of one hand of the golfer for putting a golf ball.

U.S. Pat. No. 4,746,120 to Mockovak discloses a golf club putter and handgrip therefor. An improved grip for a golf putter includes a cylindrically shaped body made of balsa wood.

U.S. Pat. No. Des. 297,040 to Shong discloses the design of a golf putter.

U.S. Pat. No. 5,046,740 to D'Eath discloses a golf putter.

In this respect, the tee putter according to the present invention substantially departs from the conventional concepts and designs of the prior art, and in doing so provides an apparatus primarily developed for the purpose of a putter which increases putting accuracy by allowing the user to putt with his arms in a parallel relationship.

Therefore, it can be appreciated that there exists a continuing need for a new and improved tee putter which can be used for a putter which increases putting accuracy by allowing the user to putt with his arms in a parallel relationship. In this regard, the present invention substantially fulfills this need.

SUMMARY OF THE INVENTION

In view of the foregoing disadvantages inherent in the known types of golf putters now present in the prior art, the present invention provides an improved tee putter. As such, the general purpose of the present invention, which will be described subsequently in greater detail, is to provide a new and improved tee putter and method which has all the advantages of the prior art and none of the disadvantages.

To attain this, the present invention essentially comprises a new and improved tee putter comprising, in combination a rectangular putting head with a striking surface that is generally flat. The rectangular putting head functions to contact a golf ball. A metal shaft has a lower end and an upper end and an intermediate extent. The lower end is secured to the rectangular putting head. A cross bar is perpendicularly integral to the upper end of the metal shaft with an externally threaded right end and an externally threaded left end. The apparatus has a right locking sleeve and a left locking sleeve. The right locking sleeve has a first end and a second end, the first end of the right locking sleeve is internally threaded. The left locking sleeve has a first end and a second end, the first end of the left locking sleeve is internally threaded. The internal thread of the right locking sleeve is engaged with the external thread of the right end of the cross bar. The internal thread of the left locking sleeve is engaged with the external thread of the left end of the cross bar. The device has a right ball detent and a left ball detent. The right ball detent is secured to the right end of the cross bar. The left ball detent is secured to the left end of the cross bar. The right ball detent has a number of female detent elements. The left ball detent has a number of female detent elements. The device has a right handle and a left handle. The right handle and left handle have a small end and a large end. The small end of the right handle has a spring biased male detent element. The small end of the left handle has a spring biased male detent element. The spring biased male detent element of the small end of the right handle is selectively engaged with one of the female detent elements of the right ball detent. The spring biased male detent element of the small end of the left handle is selectively engaged with one of the female detent elements of the left ball detent. The large end of the right handle and the large end of the left handle function as hand grips for the user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tee putter which has all the advantages of the prior art golf putters and none of the disadvantages.

It is another object of the present invention to provide a new and improved tee putter which may be easily and efficiently manufactured and marketed.

It is further object of the present invention to provide a new and improved tee putter which is of durable and reliable construction.

An even further object of the present invention is to provide a new and improved tee putter which is susceptible of a low cost of manufacture with regard to both materials and labor, and which accordingly is then susceptible of low prices of sale to the consuming public, thereby making such tee putter economically available to the buying public.

Still yet another object of the present invention is to provide a new and improved tee putter which provides in the apparatuses and methods of the prior art some of the advantages thereof, while simultaneously overcoming some of the disadvantages normally associated therewith.

Even still another object of the present invention is a putter which increases putting accuracy by allowing the user to putt with his arms in a parallel relationship.

Lastly, it is an object of the present invention to provide a new and improved tee putter comprising a rectangular putting head with a striking surface that is generally flat. The rectangular putting head functions to contact a golf ball. A metal shaft has a lower end and an upper end and an intermediate extent. The lower end is secured to the rectangular putting head. A cross bar is perpendicularly integral to the upper end of the metal shaft with an externally threaded right end and an externally threaded left end. The apparatus has a right locking sleeve and a left locking sleeve. The right locking sleeve has a first end and a second end. The first end of the right locking sleeve is internally threaded. The left locking sleeve has a first end and a second end. The first end of the left locking sleeve is internally threaded. The internal thread of the right locking sleeve is engaged with the external thread of the right end of the cross bar. The internal thread of the left locking sleeve is engaged with the external thread of the left end of the cross bar. The apparatus has a right handle and a left handle. The right handle and left handle have a small end and a large end. The small end of the right handle is secured to the second end of the right locking sleeve. The small end of the left handle is secured to the second end of the left locking sleeve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
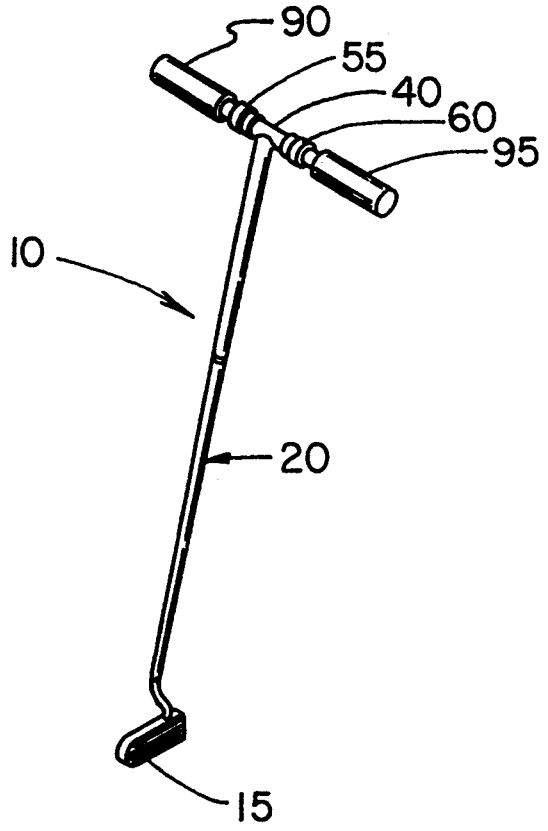
FIG. 1 is a perspective view of the preferred embodiment of the tee putter constructed in accordance with the principles of the present invention.
Figure 2:
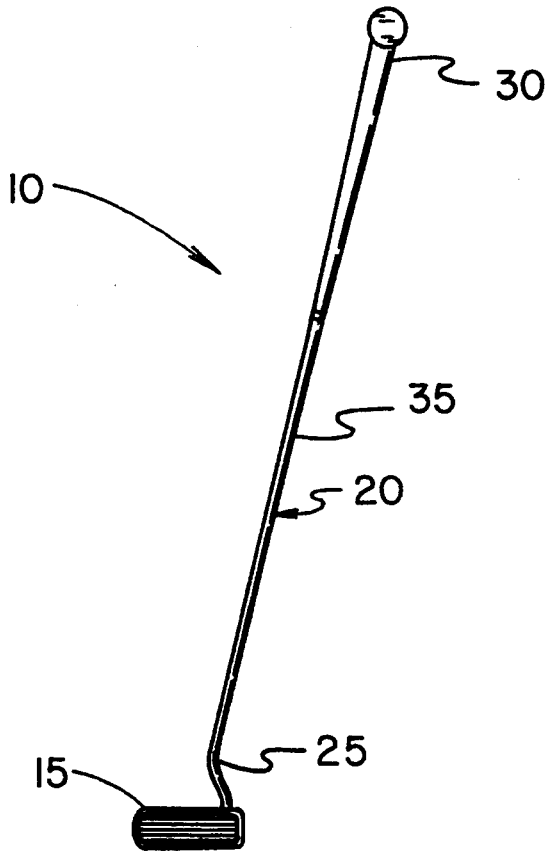
FIG. 2 is a side view of the preferred embodiment in accordance with the principles of the present invention.
Figure 3:
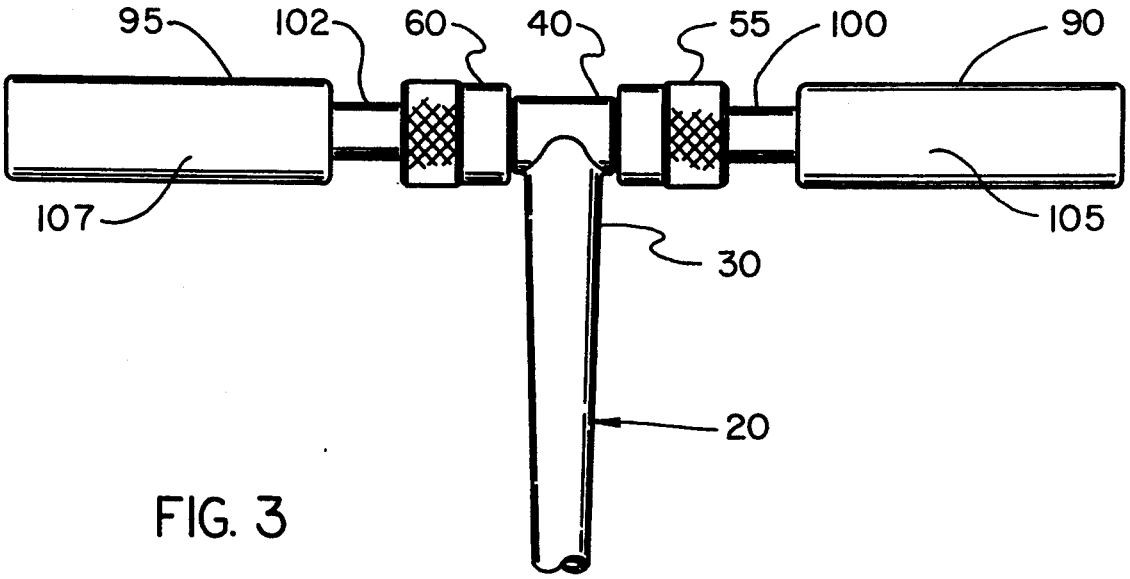
FIG. 3 is a view of the handles and crossbar in accordance with the present invention.
Figure 4:
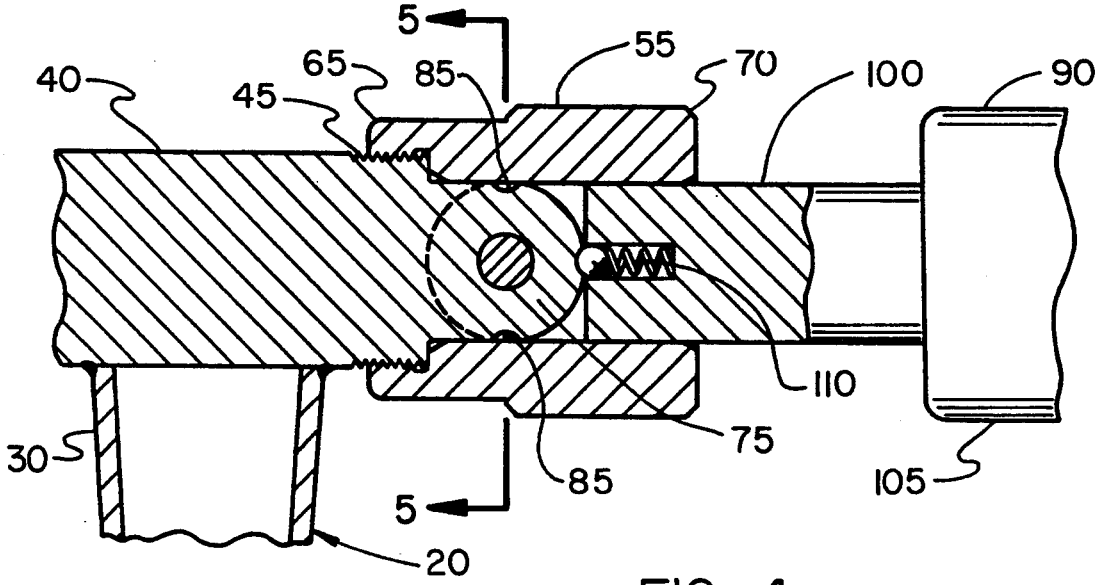
FIG. 4 is a perspective view of the locking sleeve and the ball detent in accordance with the present invention.
Figure 5:
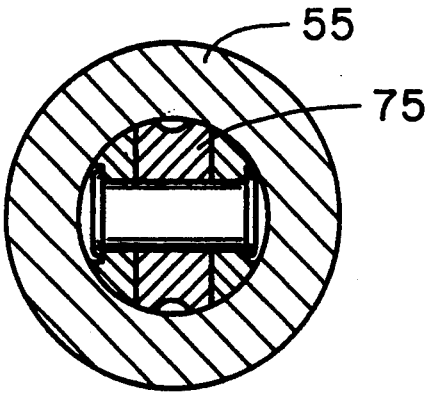
FIG. 5 is a view taken along line 5—5 of FIG. 4 of the present invention.
Figure 6:
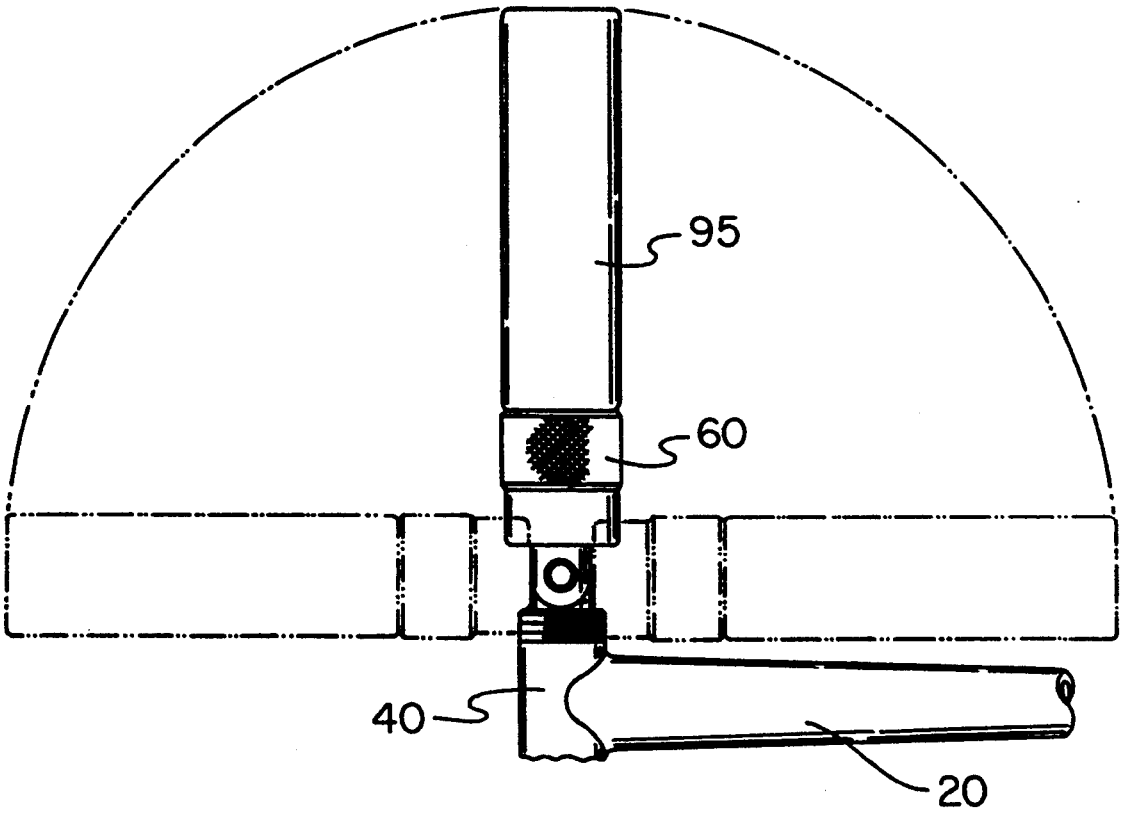
FIG. 6 is a perspective view of the ball detent, cross bar, locking sleeve, handle, and metal shaft in accordance with the present invention.

With reference now to the drawings, and in particular to FIG. 1 thereof, the preferred embodiment of the new and improved tee putter embodying the principles and concepts of the present invention and generally designated by the reference numeral 10 will be described.

More specifically, it will be noted in the various Figures that the present invention relates to a device 10 for putting golf balls with accuracy and consistency by giving the user a pre-putt read line of the golf shot. In its broadest context the device 10 includes a rectangular putting head 15, a metal shaft 20, a cross bar 40, a right locking sleeve 55, a left locking sleeve 60, a right ball detent 75, a left ball detent 80, a right handle 90, and a left handle 95.

A rectangular putting head 15 has a striking surface that is generally flat. The rectangular putting head 15 functions to contact a golf ball with the goal of placing the ball near or in the hole. A metal shaft 20 has a lower end 25 and an upper end 30 and an intermediate extent 35. The lower end 25 secured to the rectangular putting head 15. The angle at which the metal shaft is secured to the rectangular putting head corresponds to the normal design of a golf putter. A cross bar 40 perpendicularly integral to the upper end 30 of the metal shaft 20 has an externally threaded right end 45 and an externally threaded left end 50. A right locking sleeve 55 and a left locking sleeve 60. The right locking sleeve 55 has a first end 65 and a second end 70. The first end 65 of the right locking sleeve 55 is internally threaded. The left locking sleeve 60 has a first end 67 and a second end 72. The first end 67 of the left locking sleeve 60 is internally threaded. The internal thread of the first end 65 of the right locking sleeve 55 is in engagement with the external thread of the right end 45 of the cross bar 40. The internal thread of the first end 67 of the left locking sleeve 60 in engagement with the external thread of the left end 50 of the cross bar 40.

The apparatus has a right ball detent 75 and a left ball detent 80. The right ball detent 75 is secured to the right end 45 of the cross bar 40. The left ball detent 80 is secured to the left end 50 of the cross bar 40. The right ball detent 75 has a number of female detent elements 85. The left ball detent has a number of female detent elements 87. The apparatus has a right handle 90 and a left handle 95. The right handle 90 has a small end 100 and a large end 105. The left handle 95 has a small end 102 and a large end 107. The small end 100 of the right handle 90 has a spring biased male detent element 110. The small end 92 of the left handle 95 has a spring biased male detent element 112. The spring biased male detent element 110 of the small end 100 of the right handle 90 is selectively engaged with one of the female detent elements 85 of the right ball detent 75. The spring biased male detent element 112 of the small end 102 of the left handle 105 is selectively engaged with one of the female detent elements 87 of the left ball detent 80. The large end 105 of the right handle 90 and the large end 107 of the left handle 95 function as hand grips for the user, thus allowing the user to accomplish the aforementioned task of putting a golf ball near or in a hole.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved tee putter comprising, in combination:

a rectangular putting head having a striking surface that is substantially flat, the rectangular putting head functioning to contact a golf ball;

a metal shaft having a lower end and an upper end and an intermediate extent, the lower end being secured to the rectangular putting head;

a cross bar perpendicularly integral to the upper end of the metal shaft having an externally threaded right end and an externally threaded left end;

a right locking sleeve and a left locking sleeve, the right locking sleeve having a first end and a second end, the first end of the right locking sleeve being internally threaded, the left locking sleeve having a first end and a second end, the first end of the left locking sleeve being internally threaded, the internal threads of the first end of the right locking sleeve in engagement with the external threads of the right end of the cross bar, the internal threads of the first end of the left locking sleeve in engagement with the external threads of the left end of the cross bar;

a right ball detent and a left ball detent, the right ball detent secured to the right end of the cross bar, the left ball detent secured to the left end of the cross bar, the right ball detent having a number of female detent elements, the left ball detent having a number of female detent elements; and a right handle and a left handle, the right handle having a small end and a large end, the left handle having a small end and a large end, the small end of the right handle having a spring biased male detent element, the small end of the left handle having a spring biased male detent element, the spring biased male detent element of the small end of the right handle being selectively engaged with one of the female detent elements of the right ball detent, the spring biased male detent element of the small end of the left handle being selectively engaged with one of the female detent elements of the left ball detent, the large end of the right handle and the large end of the left handle functioning as hand grips for the user.

2. A tee putter comprising:

a rectangular putting head having a striking surface that is substantially flat, for functioning to contact a golf ball;

a metal shaft having a lower end and an upper end and an intermediate extent, the lower end being secured to the rectangular putting head;

a cross bar perpendicularly integral to the upper end of the metal shaft having an externally threaded right end and an externally threaded left end;

a right locking sleeve and a left locking sleeve, the right locking sleeve having a first end and a second end, the first end of the right locking sleeve being internally threaded, the left locking sleeve having a first end and a second end, the first end of the left locking sleeve being internally threaded, the internal threads of the first end of the right locking sleeve in engagement with the external threads of the right end of the cross bar, the internal threads of the first end of the left locking sleeve in engagement with the external threads of the left end of the cross bar; and a right handle and a left handle with each having a small end and a large end, the small end of the right handle secured to the second end of the right locking sleeve, the small end of the left handle secured to the second end of the left locking sleeve.

3. The apparatus as set forth in claim 2 and further comprising:

a right ball detent and a left ball detent, the right ball detent secured to the right end of the cross bar, the left ball detent secured to the left end of the cross bar, the right ball detent having a number of female detent elements, the left ball detent having a number of female detent elements;

the small end of the right handle having a spring biased male detent element, the small end of the left handle having a spring biased male detent element, the spring biased male detent element of the small end of the right handle being selectively engaged with one of the female detent elements of the right ball detent, the spring biased male detent element of the small end of the left handle being selectively engaged with one of the female detent elements of the left ball detent, the large end of the right handle and the large end of the left handle functioning as hand grips for the user.

* * * * *